US005217270A

United States Patent [19]

Awalt, Jr.

[11] Patent Number: 5,217,270

[45] Date of Patent: Jun. 8, 1993

[54] DOOR GUARD SHIELD

[75] Inventor: Thomas Y. Awalt, Jr., Pensacola, Fla.

[73] Assignee: Deep Seven Company, Pensacola, Fla.

[21] Appl. No.: 906,056

[22] Filed: Jun. 29, 1992

[51] Int. Cl.[5] ..... E05C 17/54; E05C 17/36

[52] U.S. Cl. ..... 292/346; 292/264

[58] Field of Search ..... 292/263, 264, 337, 346, 292/288, 93; 70/DIG. 58

[56] References Cited

U.S. PATENT DOCUMENTS

| | | | |
|---|---|---|---|
| 870,848 | 11/1907 | Ross | 292/346 |
| 2,244,361 | 6/1941 | Hall | 292/346 X |
| 2,798,753 | 7/1957 | Wade | 292/346 X |
| 3,271,063 | 9/1966 | Garrett | 292/346 |
| 4,725,084 | 2/1988 | Catricola | 292/346 X |

*Primary Examiner*—Richard E. Moore

[57] ABSTRACT

Door Guards are shielded from outside access with hand tools while in the open guarded position. The shields close off the opening space between the door and the jam and can be shaped to provide no leverage positions or grasping surfaces which can be used for destruction and release of the guard or opening of the door.

3 Claims, 1 Drawing Sheet

DOOR GUARD SHIELD

SUMMARY OF THE INVENTION

1. Field of the Invention

The invention relates to door guards, and more particularly to apparatus and methods for decreasing the vulnerability of door guards to damage, destruction, and release of door guards with hand tools.

2. The Prior Art

Door guards, as used herein, are those devices which are installed on doors and door jams and which, in one mode, permit the door to be opened to an "open guarded position" which is open just far enough to permit a person inside to observe, question and identify a person on the outside before opening the door far enough to permit entry. The most common types of door guards are chain guards, comprising a short length of chain, one end of which is permanently affixed to the jam. The guard may be engaged by placing a slide on the other end end of a chain in the receiver of a door-mounted slot, from which it can only be removed when the door is closed. When the slide is in the slot it restricts opening of the door. More modern door guards are comprised of hinged slots working against sliding arms. The most recent door guard is an elongated hook working against a channel closure (U.S. Pat. No. 5,154,455 issued Oct. 13, 1992). While some guards are more vulnerable than others, it has been discovered that most if not all guards can be released by pocket size hand tools from the outside when the door is in the open position in the guarded mode. Guard chains may be detached from their mounting on the jam by inserting a screwdriver into the link closest the jam and twisting the link. Guard slots may be easily broken using a pair of crescent pliers or a crescent wrench, by grasping the hinged slotted arm and twisting. The state of the art would be significantly advanced if a way were found to render door guards reasonably invulnerable to hand tools, particularly those which are pocket-size. It is therefor an object of this invention to provide a shield which prevents access of door guard-destructive tools when the door is in the guarded mode.

It is a secondary object of this invention to provide a door guard shield which itself is reasonably invulnerable to the same hand tools, and cannot be used as a leverage base for removal of the shield, dismantling of the door, destruction of the jam or in any other way for a person on the outside of the door to achieve unwanted access.

BRIEF DESCRIPTION OF THE INVENTION

These and other objects are accomplished in a door security system which in one mode permits a door to be opened to an open guarded position with a limited opening between the door and a door jam, the improvement comprising an access-denial shield spanning the limited opening for a distance along the door and jam sufficient to prevent hand tool access to the guard. In a preferred embodiment, the shield is shaped to provide no parallel grasping surfaces which could be used in conjunction with the hand tools for removal of the shield or destruction or dismantling of the door. Briefly, the latter embodiment is a shield comprising a surface mounting inclined substantially planar surface with closure means for the high side and intermediate ends, and mounting means.

In the detailed description, reference will be made to the Drawing in which.

DETAILED DESCRIPTION OF THE INVENTION

Figure 1:
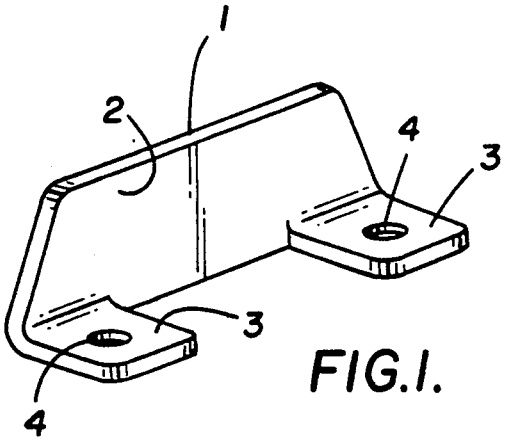
FIG. 1 is a perspective of a preferred embodiment of this invention.

Referring now to FIG. 1, shield 1 comprises closure means 2 and mounting tabs 3 with screw holes 4.

Referring now to FIG. 1, shield 5 comprises substantially planer surface 6 closure means 7 and triangular ends 8. Shield 5 is held on the door with screws or bolts running through orifices 14 in mounting tabs 9. Access orifices 10 provide access to the heads of the mounting screws or bolts.

Figure 2:
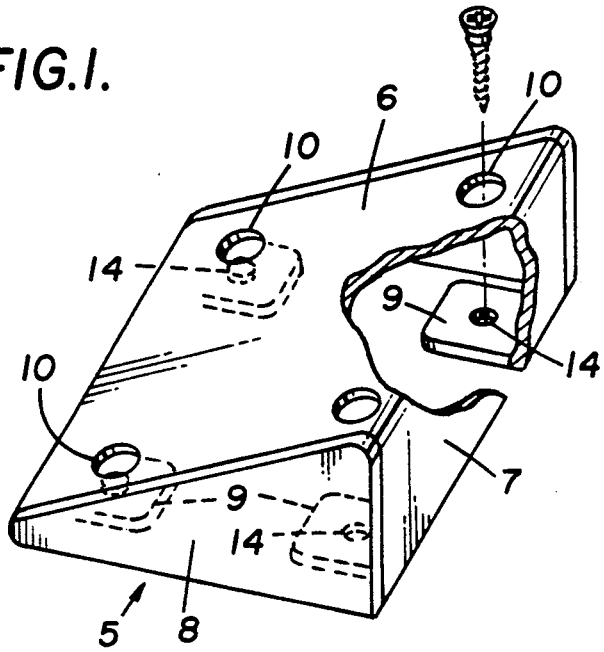
FIG. 2 is a perspective of a second preferred embodiment of this invention.
Figure 3:
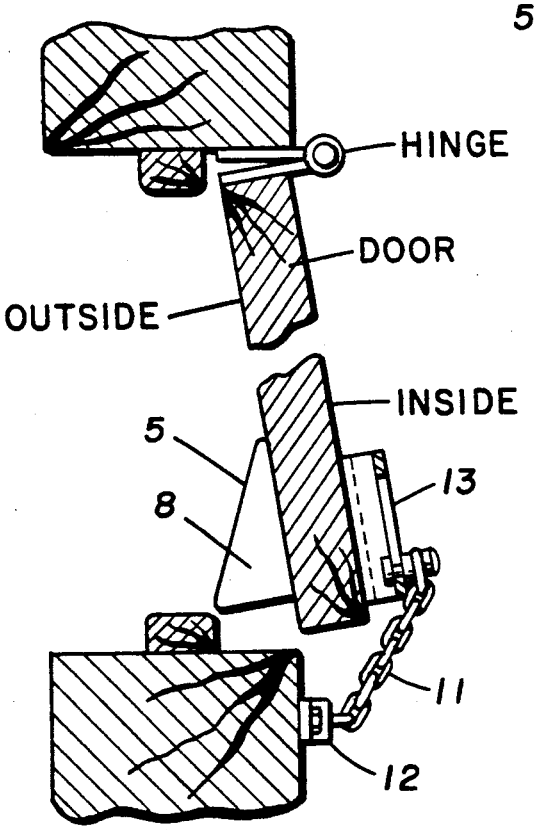
FIG. 3 is a plan view of the embodiment of FIG. 2 mounted in a guarded door security system.

Referring to FIG. 3, shield 5 is mounted on the door which in the guarded mode can be opened as far as permitted by chain guard 11, which is secured to the jamb by link mount 12, and in the guarded mode, to the door by slide mount 13. It will be noted that the shield of FIG. 1, when mounted to span the distance between the jamb and the edge of the door, denys access to the guard when the door is mode in the open guarded position mode; but closure means 2 is not without vulnerability to the use of crescent pliers, or wrenches which may be slipped over the top or bottom of the bladelike structure and used to remove the shield or dismantle the door. The embodiment of FIG. 2, however, provides, in addition to the denial of access to the guard, non-cooperative grip surfaces for leverage application to the shield, itself, or to the door through the shield.

Preferably, the shield is mounted on the door, after the guard has been mounted and while the door is in the open guarded position. The outermost edge of the shield should reach to the jamb and, with the door in the guarded open position, should be almost touching the jamb but not necessarily close enough to prevent introduction of knife-like tools, which need not be shielded against because they can do no harm to the guard. The shield should extend upwards and downwards from the guard far enough to prevent the top or bottom of the shield from being used as a lever to break the guard. I have found about 4" beyond the guard (8" total) sufficient for most guards, but this depends on the type and construction of the guard. Fastenings for the shield may be either bolts or screws, with through-bolting preferred. If screws are used it is desirable to fill the heads with epoxy or other hard filler to prevent removal. The quaisiinaccessability of the fastener heads in the embodiment of FIG. 2 may be helpful in preventing removal.

Operation of the guard is not affected by the shield.

I claim:

1. An access denial shield for a door guard when the door is in an open guarded position comprising:

(a) a substantially planar face, (b) substantially triangular ends having three legs, a first leg of each triangle defining a space at least about equal to the shortest distance between the outside edge of a door in the open guarded position and the jamb, (c) closure means in conjunction with the planar face for essentially closing the spaces defined by the first leg of each triangular end, (d) mounting means for mounting the shield on a mounting surface so that the first leg of each triangular end can approximately span the shortest distance between the outside edge of a door in the open guarded position and the jamb.

2. In a door security system including a door guard, which in one mode permits a door to be opened to an open guarded position with a limited opening between the door and a door jamb, the improvement comprising an access denial shield spanning the limited opening for a distance along the door and jamb sufficient to prevent hand tool access to the guard.

3. The improvement of claim 2 wherein the shield is shaped to provide non-cooperative grip surfaces on the shield for leverage application to the shield.

* * * * *